US007320239B1

(12) United States Patent
Kruger et al.

(10) Patent No.: US 7,320,239 B1
(45) Date of Patent: Jan. 22, 2008

(54) FORMING TOOL FOR MULTIPLE-THICKNESS BLANKS

(75) Inventors: Gary A. Kruger, Troy, MI (US); James G. Schroth, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/692,440

(22) Filed: Mar. 28, 2007

(51) Int. Cl.
*B21D 26/02* (2006.01)
*B21D 22/22* (2006.01)

(52) U.S. Cl. ..... 72/350; 72/60; 72/57

(58) Field of Classification Search ..... 72/56, 72/57, 60, 63, 350, 351, 352; 29/421.1
See application file for complete search history.

(56) References Cited

U.S. PATENT DOCUMENTS

| | | | | |
|---|---|---|---|---|
| 6,047,583 | A | 4/2000 | Schroth | |
| 6,745,604 | B1 * | 6/2004 | Morales | 72/60 |
| 6,997,025 | B2 * | 2/2006 | Friedman et al. | 72/60 |
| 7,210,323 | B2 * | 5/2007 | Kruger et al. | 72/57 |

* cited by examiner

*Primary Examiner*—David B Jones

(57) ABSTRACT

An apparatus for forming blanks having two thicknesses separated by a blank step includes a forming tool defining a binder surface that is characterized by a tool step, a first region on a first side of the tool step, a second region on a second side of the tool step, and a bead segment having a surface contiguous with the second region. The bead segment is configured to pinch material from a blank into any gap created between the tool step and the blank step caused by misalignment of the blank in the tool, thereby ensuring an effective seal to form the blank against a forming surface.

14 Claims, 3 Drawing Sheets

FORMING TOOL FOR MULTIPLE-THICKNESS BLANKS

TECHNICAL FIELD

This invention relates to forming tools having binder surfaces characterized by a step and a bead segment with a surface that is contiguous with the portion of the binder surface on one side of the step.

BACKGROUND OF THE INVENTION

Metal forming tools used in fluid forming operations, such as superplastic forming (SPF), quick plastic forming (QPF), and sheet hydroforming, typically include a first portion that defines a fluid pressure chamber and a second portion that defines a forming surface. A metal blank is placed between the first and second portions of the forming tool such that a first side of the blank is in fluid communication with the chamber and a second side of the blank faces the forming surface. Binder surfaces grip the blank along its periphery and provide a seal between the pressure chamber and the blank. Fluid pressure is introduced into the chamber, which acts on the first side of the metal blank, causing the blank to deform so that the second side contacts, and assumes the shape of, the forming surface.

Certain blanks are characterized by regions of different thicknesses. For example, a tailor welded blank includes at least two sheet elements that are welded together at respective edges thereof, forming a weld region. A tailor welded blank is thus characterized by regions of different thicknesses. In order to effect a seal across the tailor welded seam, i.e., at the transition from a first thickness to a second thickness, a tool binder surface must have a step to accommodate the thickness difference. When placing the tailor-welded blank on the forming tool it is essential to precisely locate the seam in the blank to the step in the tool to maintain a pressure-tight seal for the pressure chamber.

SUMMARY OF THE INVENTION

An apparatus for forming blanks having two thicknesses separated by a blank step is provided. The apparatus includes a forming tool defining a binder surface. The binder surface is characterized by a tool step to accommodate the blank step, a first region on a first side of the tool step, a second region on a second side of the tool step, and a bead segment having a surface that is contiguous with the second region. In the event that a blank is misaligned when it is positioned in the tool such that a gap exists between the tool step and the blank step, the seal bead segment pinches the blank to force material into the gap, thereby ensuring an effective seal despite the gap caused by the misalignment of the blank.

Accordingly, the apparatus provided herein improves upon the prior art by increasing the tolerance in positioning a multiple-thickness blank, such as a tailor welded blank, inside the tool while ensuring an effective seal between the blank and the binder surface, and correspondingly ensuring adequate pressure in a pressure chamber to form the blank against a forming surface.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
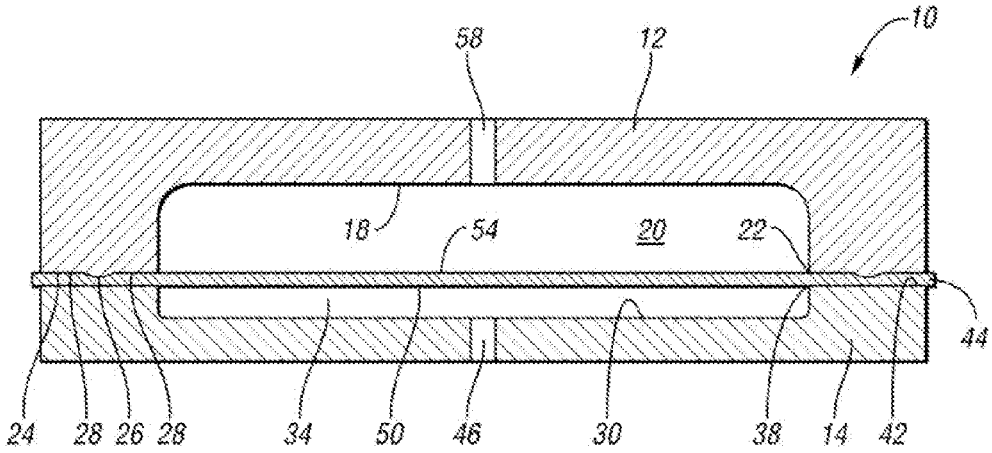
FIG. 1 is a schematic, cross-sectional view of a metal forming apparatus including first and second forming tools having first and second binder surfaces, respectively.

Referring to FIG. 1, a metal forming apparatus 10 for fluid forming blanks is schematically depicted. The apparatus 10 may be configured for any fluid forming process within the scope of the claimed invention, such as superplastic forming, quick plastic forming, sheet hydroforming, etc. The apparatus 10 includes an upper tool 12 and a complementary lower tool 14. The forming tool 12 defines a surface 18 that has been cast and machined into the tool body. The surface 18 defines a cavity 20 having an opening 22. The forming tool 12 also defines a binder surface 24 that circumscribes the surface 18 and the cavity opening 22. Binder surface 24 includes a seal bead 26 and shallow valleys 28, one on each side of bead 26.

Figure 2:
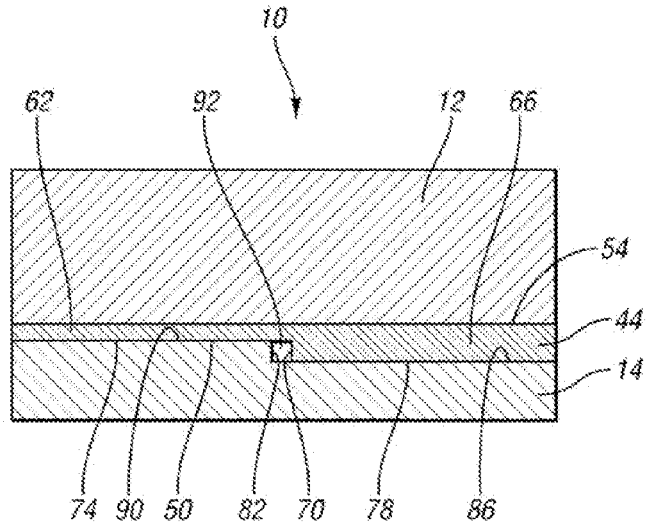
FIG. 2 is a schematic, side view of the metal forming apparatus of FIG. 1.
Figure 3:
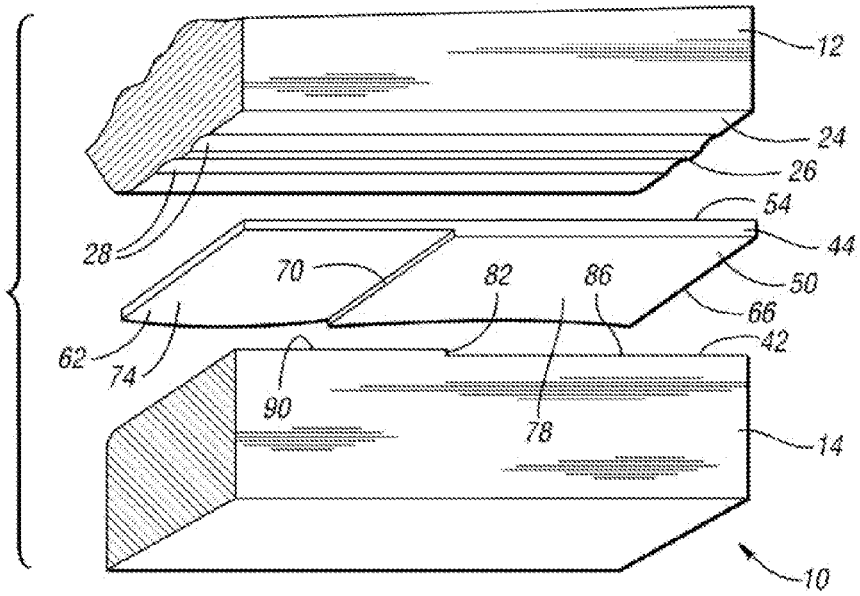
FIG. 3 is a schematic, perspective view of a portion of the first and second forming tools.
Figure 5:
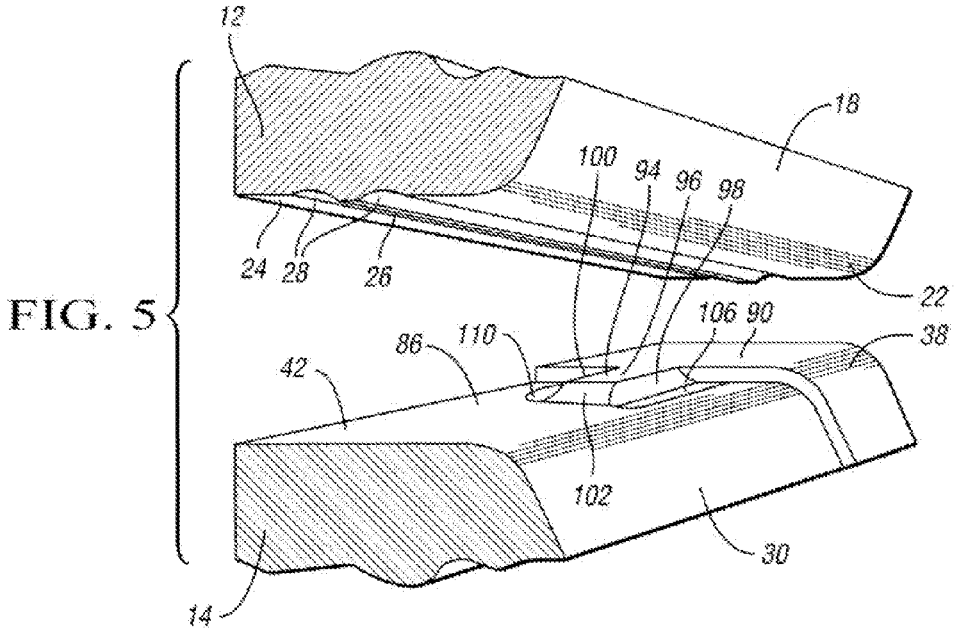
FIG. 5 is schematic, perspective view of a portion of the first and second binder surfaces.

Forming tool 14 is characterized by a surface 30 that defines a cavity 34 having an opening 38. The tool 14 also defines a binder surface 42 circumscribing the surface 30 and the cavity opening 38. The tools 12, 14 are movable with respect to one another from an open position, as shown in FIGS. 3 and 5, to a closed position, as shown in FIGS. 1 and 2, in which the binder surface 24 of tool 12 opposes binder surface 42 of tool 14 such that the binder surfaces 24, 42 cooperate to grip the periphery of a metal blank 44. Blank 44 is comprised of a metal suitable for fluid forming. Those skilled in the art will recognize various metals that are suitable for fluid forming.

In the embodiment depicted, surface 18 is a forming surface, and cavity 34 is a pressure chamber. During operation of the metal forming apparatus 10, pressurized fluid, such as water, air, nitrogen, or argon gas, is introduced into the cavity 34 through an inlet 46 formed in the tool 14. The blank 44 is characterized by opposing sides 50, 54, and spans the opening 38 of the cavity 34 such that one side 50 of the blank 44 is in fluid communication with the cavity 34. The pressure of the fluid from the cavity 34 acts on side 50 of the blank 44, causing the blank 44 to deform such that side 54 of the blank contacts, and assumes the shape of, the forming surface 18. Tool 12 defines an outlet 58 through which air in the cavity 20 can exit as it is displaced by the movement of the sheet 44 into the cavity 20 and against the forming surface 18.

As understood by those skilled in the art, the binder surfaces 24, 42 must sufficiently grip the entire periphery of the blank 44 to create a pressure-tight seal with the blank 44 to prevent fluid from leaking from the cavity 34. That is, the blank 44 must seal the entire opening 38 of the cavity 34 in order to prevent fluid from leaking from the cavity 34.

Alternatively, and within the scope of the claimed invention, surface 30 may be a forming surface, cavity 20 may be a pressure chamber, element 46 may be an outlet, and element 58 may be an inlet.

Referring to FIGS. 2 and 3, wherein like reference numbers refer to like components from FIG. 1, the blank 44 is a tailor welded blank having a first portion 62 and a second portion 66. The second portion 66 is thicker than the first portion 62. Side 50 of the blank 44 is characterized by a step 70 at the weld seam. The step 70 separates a first region 74 of surface 50, which is formed by the thin portion 62 of the blank 44, and a second region 78 of surface 50, which is formed by the thick portion 66 of the blank 44.

Correspondingly, the binder surface 42 of the tool 14 is characterized by a step 82 to accommodate the difference in thickness between the first and second portions 62, 66 of the blank 44. The step 82 separates a first region 86 of the binder surface 42 and a second region 90 of the binder surface 42. The first region 86 is configured to contact, and form a seal along, the peripheral portion of the thick portion 66 of the blank 44. The second region 90 is more protuberant than the first region 86. The second region 90 is configured to contact, and form a seal along, the peripheral portion of the thin portion 62 of the blank 44. In the embodiment depicted, regions 86, 90 are substantially flat, but may have contours within the scope of the claimed invention, e.g., to accommodate a contoured blank.

In the embodiment depicted, the step 70 at the weld seam of the blank 44 is characterized by a surface that is perpendicular to surfaces 50, 54. If the step 70 of the blank 44 is not in contact with the step 82 of the binder surface 42 when the tools 12, 14 are closed, as shown in FIG. 2, then a gap 92 is formed therebetween, which will allow pressure from the cavity 34 to leak therethrough.

Figure 4:
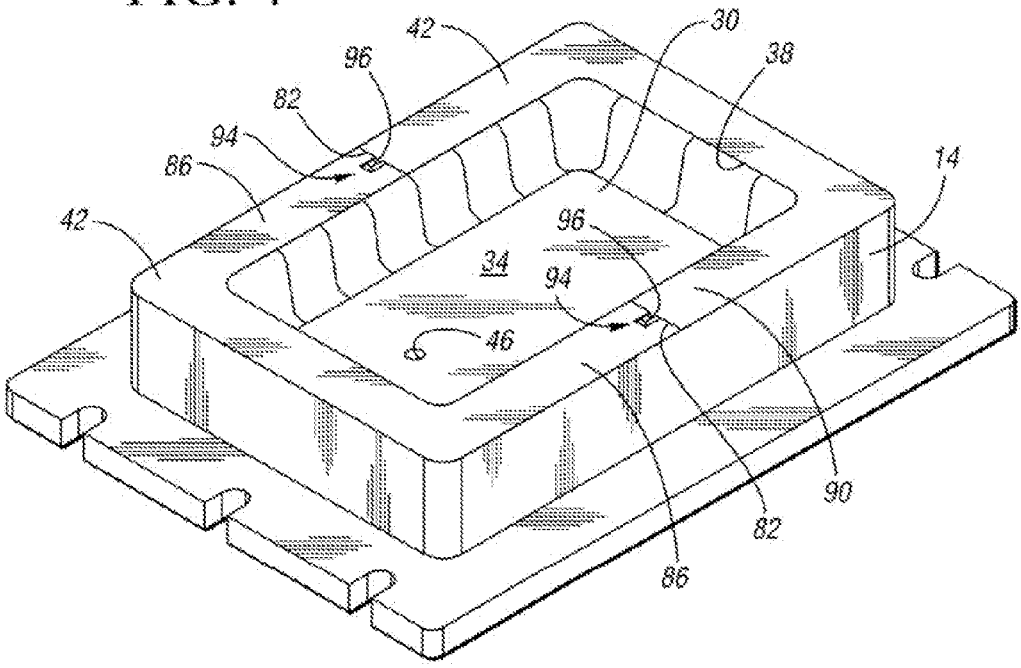
FIG. 4 is a schematic, perspective view of the first forming tool.

Referring to FIG. 4, wherein like reference numbers refer to like components from FIGS. 1-3, the binder surface 42 is characterized by two steps 82 that are on opposite sides of the cavity 34 from one another. The binder surface 42 includes two bead segments 94 that protrude from the steps 82. Each of the bead segments 94 includes a surface 96 that is contiguous with the second region 90 and forms a peninsular portion thereof. The first region 86 surrounds the bead segment 94 and surface 96 on three sides thereof. The bead segment 94 and surface 96 are narrower than the second region 90. In the embodiment depicted, no part of the bead segment is more protuberant than the second region 90. Surface 96 in the embodiment depicted is flat and is coplanar with region 90; however, surface 96 may be contoured within the scope of the claimed invention, e.g., to accommodate a contoured blank.

Figure 6:
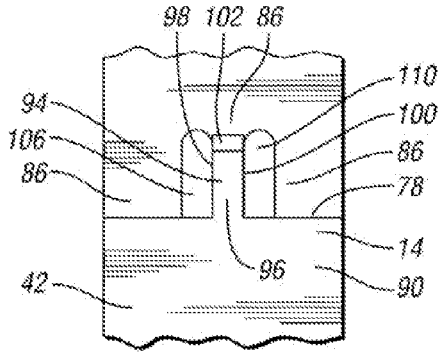
FIG. 6 is a schematic, top view of a portion of the first binder surface.

Referring to FIGS. 4-6, each bead segment 94 is characterized by an inner lateral side 98 and an outer lateral side 100 opposite from the inner lateral side 98. The first region 86 extends on both sides 98, 100 of the bead segment. Surface 102 of the bead segment interconnects the surface 96 and the first region 86.

The binder surface 42 further defines a valley portion 106 that is between, and that interconnects, the first region 86 with the lateral side 98 of the bead segment 94. The binder surface 42 also defines valley portion 10 that is between, and that interconnects, the first region 86 with the lateral side 100 of the bead segment 94. At least part of each of the valley portions 106, 110 is less protuberant than the first region 86.

Figure 7:
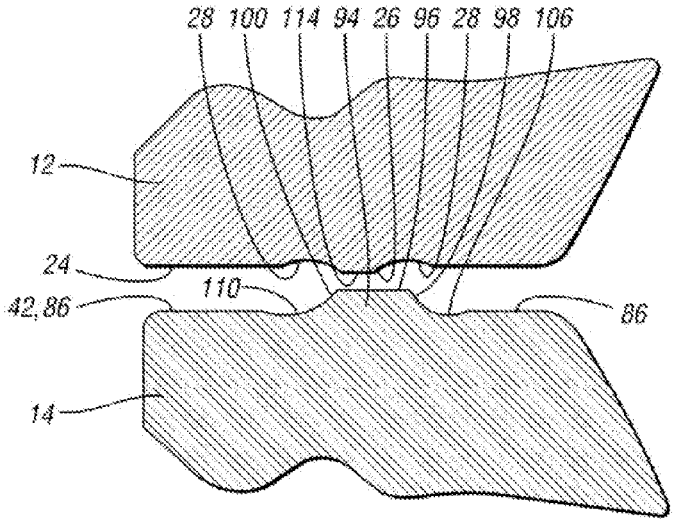
FIG. 7 is a schematic, cross-sectional view of a portion of the first and second tools.

Referring to FIG. 7, wherein like reference numbers refer to like components from FIGS. 1-6, the sealing bead 26 has a cusp-shaped cross-section. As used herein, the term "cusp" refers to the shape formed by two interconnected arcs, which may or may not intersect each other. For example, and within the scope of the claimed invention, a cusp may be defined by two arcs that intersect at a point, two arcs connected by a flat surface, etc. In the embodiment depicted, each valley 28 cooperates with a respective lateral side of the bead 26 to define a respective arc that is interconnected by surface 114.

The cusp-shaped seal bead 26 may be suitably formed by machining the binder surface 24 using two offset spherical cutters (not shown) moved in suitably-spaced parallel paths. The bead 26 is cut in a suitable path, typically a linear path, around the periphery of the tool 12 as necessary to enclose and sealingly engage the perimeter of the blank 44. More specifically, each of the offset cutters forms a respective one of the valleys 28 and lateral sides of the bead 26, such that each of the valleys 28 cooperates with a respective side of the bead to define a respective arc in cross section, as shown in FIG. 7. After the two spherical cutting tools have traced their respective paths in the binder surface 24 to form the valleys 28, the arcs intersect each other at a point; a final flat cutting tool (not shown) is supplied both to remove the tip of the cusp and to provide a truncated cusp with the flat surface 114 that is more protuberant than the remainder of surface 24.

Similarly, bead segment 94 may also be cusp-shaped in cross section, with the valley 106 and side 98 cooperating to define a first arc and valley 110 and side 100 cooperating to define a second arc, and surface 96 being a flat surface interconnecting the first and second arcs, as shown in FIG. 7. It should be noted that one of the valleys 106, 110 may be omitted in some applications. It should also be noted that, in the embodiment depicted, surface 96 is wider than surface 114, and valleys 106, 110 are larger than valleys 28. It may be desirable for the bead 26 to be offset from the bead segment 94 toward the inside of the tool 14 to reduce or eliminate tearing of the blank during forming, i.e., the centerline of sealing bead 26 is not aligned with the centerline of the bead segment 94. It should also be noted that, although the regions 86, 90 and the bead segment 94 are integrally formed in the tool 14 in the embodiment depicted, various features of a binder surface may be formed by separate pieces within the scope of the claimed invention.

The operation of the metal forming apparatus 10 is described with reference to the forming of a tailor welded blank 44; however, the metal forming apparatus 10 may be advantageously employed in the formation of any blank characterized by regions of different thicknesses.

While the best modes for carrying out the invention have been described in detail, those familiar with the art to which this invention relates will recognize various alternative designs and embodiments for practicing the invention within the scope of the appended claims.

The invention claimed is:

1. An apparatus for forming blanks having two thicknesses separated by a blank step, the apparatus comprising:

a forming tool defining a binder surface, said binder surface characterized by a tool step, a first region on a first side of the tool step, a second region on a second side of the tool step, and a bead segment having a surface contiguous with the second region.

2. The apparatus of claim 1, wherein the first region is contiguous and extends on opposite sides of the bead segment.

3. The apparatus of claim 1, wherein the binder surface includes a valley portion that is less protuberant than the first region and the second region, and that is between the first region and the bead segment.

4. The apparatus of claim 3, wherein the forming tool further defines one of a forming surface and a pressure chamber.

5. An apparatus for forming a metal blank characterized by two thicknesses, the apparatus comprising:

a first tool defining a first binder surface;

a second tool defining a second binder surface;

one of said first and second tools defining a forming surface and the other of said first and second tools defining a pressure chamber;

said first and second tools being selectively movable with respect to one another to a closed position in which the first binder surface opposes the second binder surface to grip the metal blank; and said first binder surface being characterized by a step, a first region on a first side of the step, a second region on a second side of the step, and a bead segment having an upper surface contiguous with the second region.

6. The apparatus of claim 5, wherein the upper surface of the bead segment is substantially coplanar with the second region.

7. The apparatus of claim 5, wherein the bead segment is cusp-shaped.

8. The apparatus of claim 5, wherein the first binder surface defines a valley portion along a side of the bead segment; said valley portion being less protuberant than the first region.

9. The apparatus of claim 5, wherein the second binder surface includes a sealing bead.

10. The apparatus of claim 9, wherein the sealing bead is characterized by a cusp-shaped cross-section.

11. The apparatus of claim 9, wherein the sealing bead is offset from the bead segment when the first tool is in the closed position.

12. The apparatus of claim 5, wherein the first region is contiguous and extends on opposite sides of the bead segment.

13. The apparatus of claim 5, wherein the first binder surface includes a valley portion that is between the first region and the bead segment.

14. An apparatus for forming blanks having multiple thicknesses, the apparatus comprising:

a forming tool defining a binder surface characterized by a step, a first region on a first side of said step and a second region on a second side of said step, and a bead segment protruding from the step and having a surface that is substantially contiguous with the second region.

* * * * *